US005786768A

United States Patent [19]

Chan et al.

[11] Patent Number: 5,786,768

[45] Date of Patent: Jul. 28, 1998

[54] CLOCK RADIO GAS DETECTOR APPARATUS AND METHOD FOR ALERTING RESIDENTS TO HAZARDOUS GAS CONCENTRATIONS

[75] Inventors: James C. K. Chan, Unionville; Patrick F. C. Hung, Vaughan, both of Canada

[73] Assignee: Patrick Plastics Inc., Vaughan, Canada

[21] Appl. No.: 834,402

[22] Filed: Apr. 16, 1997

[51] Int. Cl.[6] ..... G08B 21/00

[52] U.S. Cl. ..... 340/632; 340/628; 340/540; 368/11

[58] Field of Search ..... 340/632, 501, 340/634, 521, 628, 540, 541; 368/11; 364/496, 497

[56] References Cited

U.S. PATENT DOCUMENTS

| | | | |
|---|---|---|---|
| 4,321,591 | 3/1982 | Vieweg | 340/521 |
| 4,340,885 | 7/1982 | Chavis et al. | 340/632 |
| 4,371,751 | 2/1983 | Hilligoss, Jr. et al. | 379/41 |
| 4,464,653 | 8/1984 | Winner | 340/501 |
| 4,611,200 | 9/1986 | Stilwell | 340/628 |
| 4,896,143 | 1/1990 | Dolnick et al. | 340/634 |
| 4,949,077 | 8/1990 | Mbuthia | 340/628 |
| 5,184,500 | 2/1993 | Krema et al. | 73/23.2 |
| 5,309,145 | 5/1994 | Branch et al. | 340/540 |
| 5,319,698 | 6/1994 | Glidewell et al. | 379/39 |
| 5,486,810 | 1/1996 | Schwarz | 340/521 |
| 5,526,280 | 6/1996 | Consadori et al. | 364/496 |

*Primary Examiner*—Jeffery A. Hofsass
*Assistant Examiner*—Davetta Woods
*Attorney, Agent, or Firm*—Bereskin & Parr

[57] ABSTRACT

An alerting apparatus for alerting residents to hazardous gas concentrations, comprising an alarm clock, a gas sensor, a microcontroller, and visual display and auditory speech warning means for producing a wake-up alarm and a hazardous gas warning. When the alerting apparatus detects a dangerous level of carbon monoxide, initial visual display and auditory speech warnings are provided to the user using a digital display and a voice synthesizer. The visual and speech warning messages provide the user with warnings and instructions appropriate to the concentration of gas detected and time of exposure. The user may then retrieve further visual and auditory messages which provide a detailed gas detection event history.

16 Claims, 6 Drawing Sheets

CLOCK RADIO GAS DETECTOR APPARATUS AND METHOD FOR ALERTING RESIDENTS TO HAZARDOUS GAS CONCENTRATIONS

FIELD OF THE INVENTION

This invention relates to apparatus and methods for warning residents of dangerous levels of gases, and more particularly to carbon monoxide gas detectors for residential use.

BACKGROUND OF THE INVENTION

Modern homes are currently designed and constructed to be air tight environments. Standard residential fuel-burning furnaces require a sufficient supply of oxygen in order to achieve complete fuel combustion. When there is incomplete combustion of heating fuels such as natural gas, carbon monoxide gas is created. Carbon monoxide is a colourless, odourless, tasteless, and invisible gas which acts as a highly dangerous cumulative toxicant. When carbon monoxide is inhaled into the human body, it replaces oxygen molecules in the human body's hemoglobin. If a person continues to inhale carbon monoxide, more and more oxygen molecules are replaced, and eventually, the person experiences difficult breathing, nausea, brain damage and even death.

Since carbon monoxide is a cumulative toxicant, Underwriters Laboratories Standard UL 2034 requires that carbon monoxide detectors alert users to conditions of 100 parts per million (ppm) of carbon monoxide gas within 90 minutes of exposure, 200 ppm within 35 minutes of exposure, and 400 ppm within 15 minutes of exposure. The Underwriters Laboratories Standard UL 2034 also requires all carbon monoxide detectors to include an alarm buzzer with a loudness of at least 85 db.

An effective way to monitor the presence of carbon monoxide in a residential home, is to place a carbon monoxide detector in a bedroom, where residents spend substantial periods of time in the especially vulnerable activity of sleeping. U.S. Pat. No. 4,321,591 to Vieweg discloses a portable multiple warning device, which includes an alarm clock and a smoke or gas detector. However, the gas detector only provides the user with a single type of audible alarm to indicate dangerous levels of gases such as carbon monoxide. This device does not advise the user of specific gas detection information, or provide safety instructions appropriate to the concentration of gas detected and time of exposure.

Many commercial available carbon monoxide detectors utilize an alarm buzzer or various combinations of visual alerting apparatus, such as coloured LEDs, to alert users to the presence of carbon monoxide gas at the aforementioned levels and periods of exposure. While some emergency alarm systems include a facility for verbally alerting users, they do not advise the user specifically of gas detection information or provide appropriate related safety instructions.

In particular, while U.S. Pat. No. 5,319,698 to Glidewell et al. discloses a security system which utilizes a speech synthesizer to inform a user of details regarding an on-going emergency at a remote location, it only provides information regarding the time, date and type of alarm, i.e. burglary, fire or gas alarm. Further, while U.S. Pat. No. 4,464,653 to Winner, provides the user with vocal messages identifying the nature of a malfunction in a combustible gas detection system, the system does not provide any further gas detection information.

The use of buzzers or tone alarms to provide one kind of alerting signal for all different types of alarm conditions may cause users to disregard the alarm when they do not believe that a dangerous level of carbon monoxide is present, even though such a dangerous level may in fact have been detected. The ambiguity created by the utilization of one alarm signal to indicate the presence of a wide range of carbon monoxide levels, creates a significant danger. The user of such an alarm cannot distinguish between the severity of alarm conditions and cannot make an informed choice as to what recommended safety procedures to follow.

While commercially available carbon monoxide detectors provide warning means for alerting the user to the presence of toxic carbon monoxide conditions, they do not provide retrievable detection event information relating to the specific concentration of the carbon monoxide gas and time of exposure. Many fire department and emergency response agencies upon responding to a user's request for assistance, require specific historical information relating to the gas leak. Typically, all the user can tell the authorities is that their carbon monoxide detector has detected carbon monoxide on several occasions.

Accordingly, there is a need for gas detector alerting apparatus which is adapted to be operated in a user's bedroom, and which provides the user with an appropriate audible speech warning in the form of safety instructions corresponding to the concentration of carbon monoxide gas and time of exposure, which provides the user with sufficient information to make an informed decision as to the proper emergency response, and which provides retrievable historical information relating to the specific concentration and duration of the carbon monoxide gas detected for diagnostic use by safety officials.

SUMMARY OF THE INVENTION

The present invention is directed to an apparatus for alerting residents to hazardous gas concentrations, comprising an alarm clock, a gas sensor, a controller and warning means. The alarm clock tracks the current time of day and issues a wake-up alarm. The gas sensor senses the concentration of a specified hazardous gas and generates correlatable sensor signals. The controller is operatively coupled to the alarm clock and the gas sensor, and determines the durations of the various concentrations based upon the sensor signals and generates output signals indicative of the various concentrations. The warning means is operatively coupled to the controller, and issues a hazardous gas warning, distinct from the wakeup alarm, indicative of the gas concentration sensed by the gas sensor. The warning means comprises voice synthesizer means for issuing at least one spoken message and display means for displaying the current time of day and gas concentration information.

In a preferred embodiment, the warning means also issues a warning indicative of the real time at which the alarm was issued, the alarm clock includes a radio, and the warning means includes means for providing an alternative wake-up alarm for the alarm clock utilizing the radio.

The present invention is also directed to a method for alerting residents to hazardous gas concentrations, beginning with the generation of real time values and the sensing of the concentration of a specified hazardous gas. Upon sensing a non-zero concentration of the specified hazardous gas, the duration of the presence of the sensed gas is calculated by storing and comparing appropriate real time values. The presence of alarm conditions is determined by determining whether the concentration of the gas and the duration of the concentration of the gas satisfy a set of hazardous gas warning alarm conditions. Upon determining that the set of hazardous gas warning alarm conditions are satisfied, initial visual and audible warnings are produced including an initial audible speech warning. Finally, upon receiving a test switch signal from the user, a detailed visual warning is produced and a detailed audible speech warning is selected and produced.

BRIEF DESCRIPTION OF THE DRAWINGS

The invention will now be described, by way of example only, with reference to the following drawings, in which.

DETAILED DESCRIPTION OF THE PREFERRED EMBODIMENT

Figure 1:
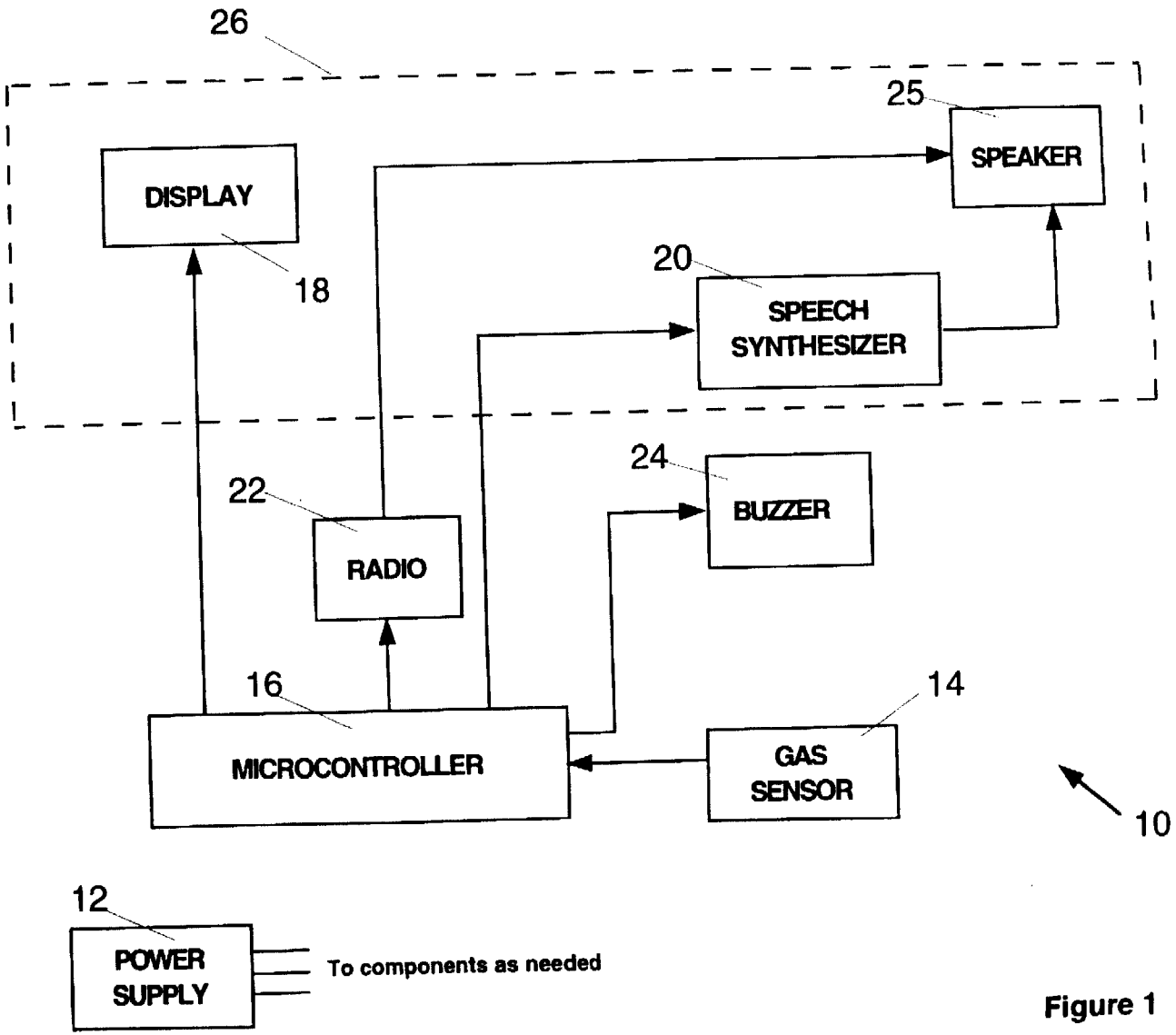
FIG. 1 is a block diagram of a preferred embodiment of the present invention.

Referring to FIG. 1, illustrated therein is an alerting apparatus 10 made in accordance with a preferred embodiment of the present invention. Alerting apparatus 10 includes a power supply 12, a gas sensor 14, and a microcontroller 16. Power supply 12 is powered by a transformer with 120 VAC source. Gas sensor 14 uses a metal oxide semiconductor sensor responsive to the presence of carbon monoxide gas, and is coupled to a microcontroller 16.

Microcontroller 16 is electrically coupled to a display 18, a speech synthesizer 20, a radio 22, and a buzzer 24. In turn, speech synthesizer 20 and radio 22 are coupled to a speaker 25. Microcontroller 16 is programmed to operate with display 18 and radio 22, as a clock radio alarm device with the functionality of a commercially available alarm clock radio. Microcontroller 16 causes an appropriate current time value to appear on the display 18 and activates a user selected type of clock alarm when the clock's time value reaches a user preset alarm value. Microcontroller 16 can activate a tone alarm by enabling speech synthesizer 20 to produce a tone which is then transmitted through speaker 25. Microcontroller 16 can activate a radio alarm by enabling radio 22, whose signal is then transmitted through speaker 25.

Microcontroller 16 is also programmed to function with gas sensor 14, speech synthesizer 20, buzzer 24, and speaker 25, as a sophisticated carbon monoxide gas detector and alerting device using a specially enhanced auditory and visual warning means 26. Warning means 26 includes display 18, speech synthesizer 20 and speaker 25. Microcontroller 16 receives an input signal from gas sensor 14 and determines whether an emergency carbon monoxide condition exists. When microcontroller 16 determines that such an emergency condition exists, it enables buzzer 24, disables radio 22, and enables speech synthesizer 20. Microcontroller 16 may additionally enable buzzer 24. Microcontroller 16 then sends an information signal to speech synthesizer 20 to control what kind of message it will generate. Speech synthesizer 20 then transmits the generated message signal through speaker 25. Finally, microcontroller 16 disables the display of the current time value, and sends an information signal corresponding to detected alarm gas conditions to display 18.

Figure 2:
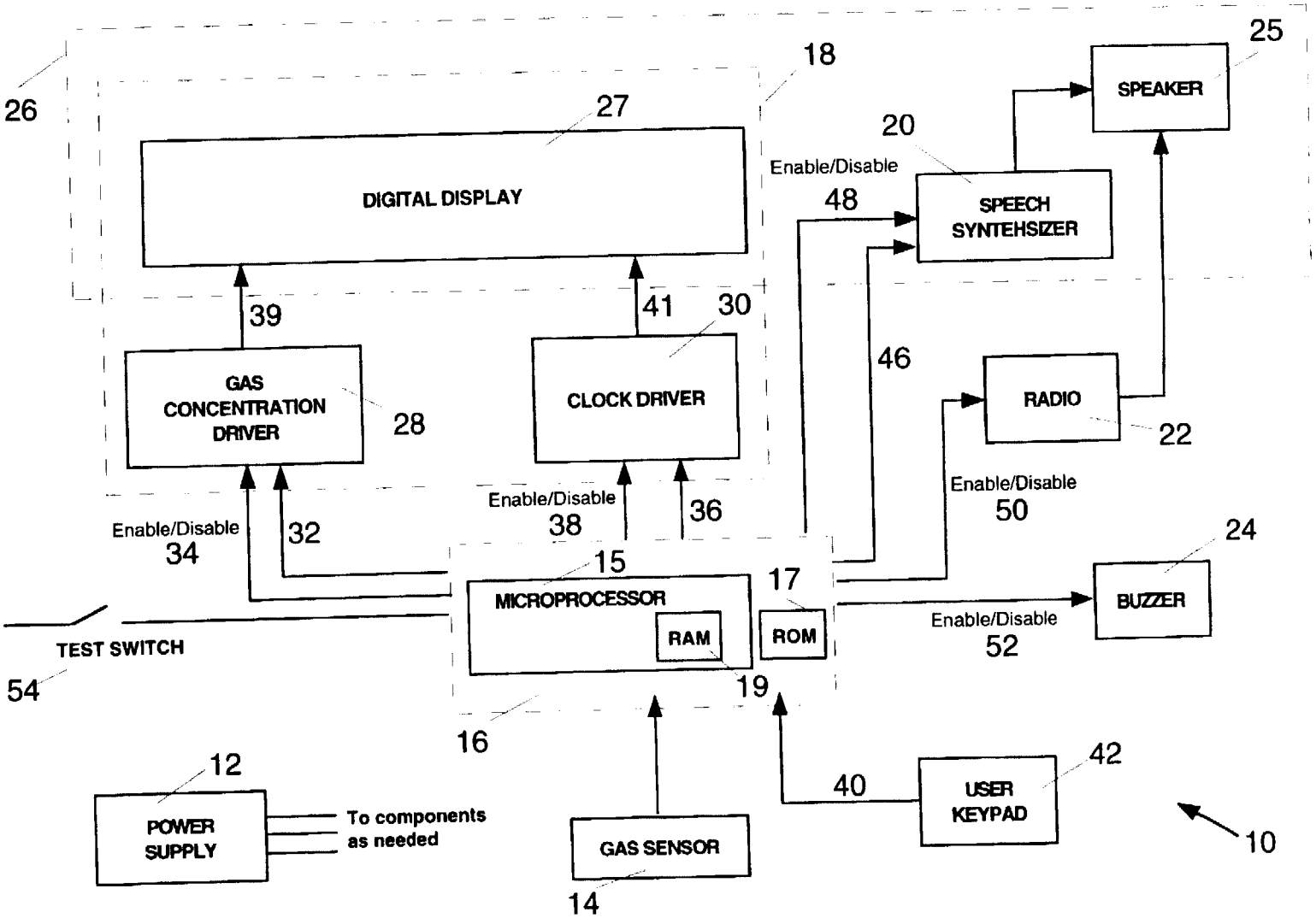
FIG. 2 is a schematic diagram of the preferred embodiment.

Referring now to FIG. 2, microcontroller 16 includes a microprocessor 15, which is an integrated circuit of the type 1600 series manufactured by Microchip Technologies, although it should be understood that any type of logic circuit with similar operating functions can be utilized. Storage of program instructions and other static data is provided by a read only memory (ROM) 17, while storage of dynamic data is provided by a random access memory (RAM) 19. Both memory units 17 and 19 are controlled and accessed by microcontroller 16 in a conventional manner. Power supply 12 contains a battery backup to support the retention of the contents of RAM 19, in the event of a main AC power failure.

Display 18 includes a digital display 27, a gas concentration display driver 28, and a clock driver 30. Digital display 27 may be any seven segment LED or LCD display, capable of displaying digits. Microcontroller 16 is electrically connected to gas concentration display driver 28 and clock driver 30, both of which are in turn coupled to digital display 27. Further, microcontroller 16 is connected to gas concentration display driver 28 through an information line 32 and an enable/disable line 34, and is connected to clock driver 30 through an information line 36 and an enable/disable line 38. Gas concentration display driver 28 and clock driver 30 are connected to digital display 27 through display lines 39 and 41, respectfully.

Information lines 32 and 36 carry digital information signals generated by microcontroller 16, which are intended for display on digital display 27. For example, information lines 32 and 36 could carry digital information corresponding to the current time or the concentration of carbon monoxide gas detected in parts per million. In turn, display lines 39 and 41 instruct digital display 27 to display the appropriate combination of seven segment configurations corresponding to the digital information generated by microcontroller 16. Microcontroller 16 either enables or disables gas concentration display driver 28 by sending the appropriate digital signal through enable/disable line 34. Microcontroller 16 also either enables or disables clock driver 30 by sending the appropriate digital signal through enable/disable line 38.

Microcontroller 16 is further coupled to speech synthesizer 20 and radio 22 which are in turn coupled to speaker 25. Microcontroller 16 is connected to speech synthesizer 20 through an information line 46 and an enable/disable line 48 and is connected to radio 22 through an enable/disable line 50. Microcontroller 16 is also coupled to buzzer 24 through an enable/disable line 52. Finally, an alarm clock line 40 is located between microcontroller 16 and a user input keypad 42. Accordingly, microcontroller 16 receives a signal from user input keypad 42 over alarm clock line 40 which carries current time and alarm time setting information.

Information line 46 carries digital information signals containing instructions and numerical information to speech synthesizer 20. The instructions can either instruct speech synthesizer 20 to select and produce one of a number of preset audible speech messages or to generate an audible speech message incorporating the numerical information into a ROM-stored preset speech message template. For example, information line 46 could carry a digital information signal containing the instruction to play a preset moderate danger warning message. In turn, speech synthesizer 20 would select and produce the appropriate warning message for transmission through speaker 25. Microcontroller can either enable or disable speech synthesizer 20 by sending the appropriate digital signal through enable/disable line 46. Microcontroller can also either enable or disable radio 22 by sending the appropriate digital signal through enable/disable line 50.

Figure 3:
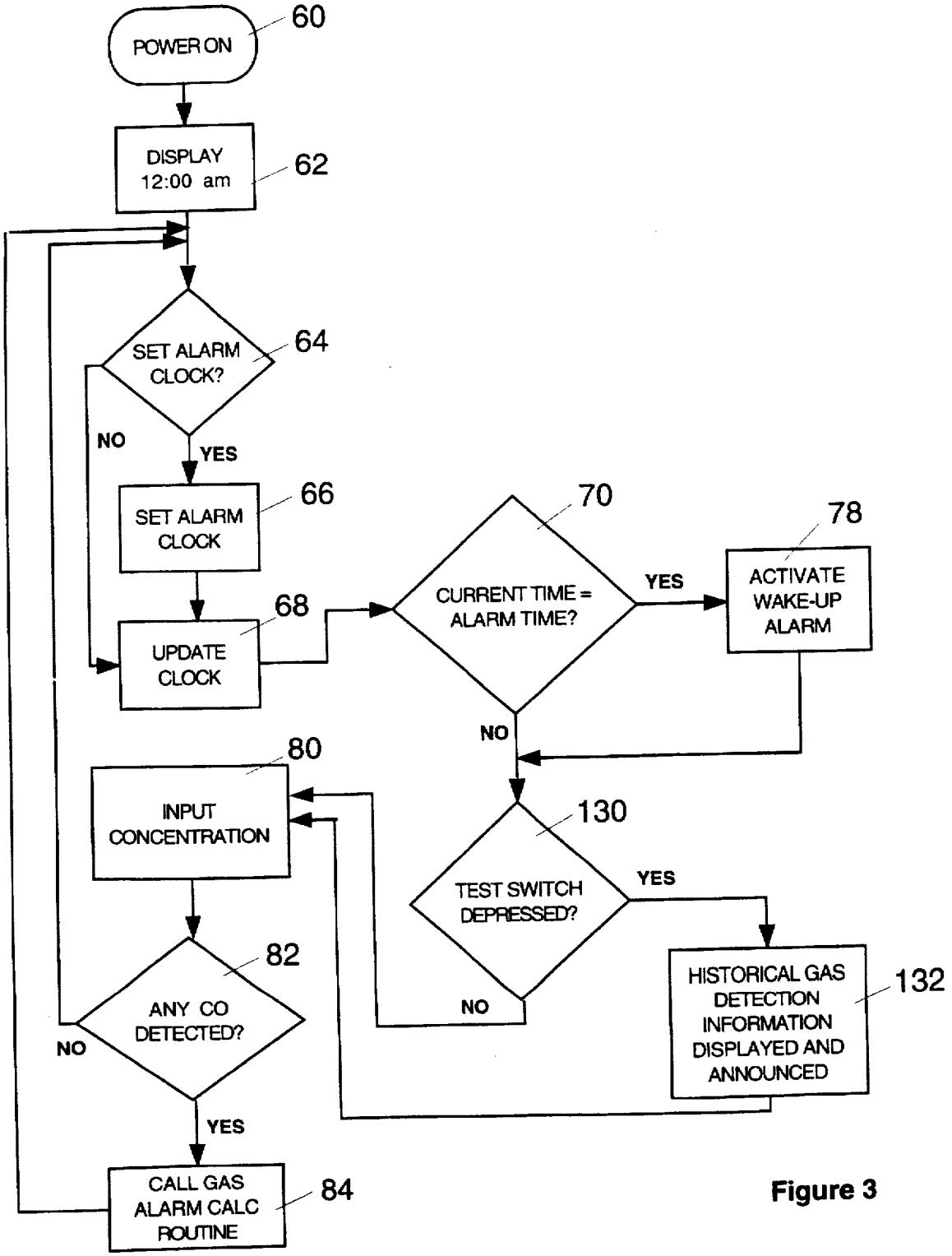
FIG. 3 is a flow-chart of the MAIN OPERATION routine used in the normal operation of the present invention.

Referring now to FIGS. 2 and 3, illustrated in FIG. 3 is the MAIN OPERATION routine utilized by microcontroller 16 to control the operations of alerting apparatus 10. When alerting apparatus 10 first receives power at step 60, microcontroller 16 enables clock driver 30 through enable/disable line 38 and sends default time information representing "12:00 am" at step 62, through information line 36 to clock driver 30. If user input keypad 42 does not register any user inputs, then the default time or "12:00 am" remains the initial time value of the clock.

A user can set a particular real-time clock alarm value as shown by steps 64 and 66, by entering numerical data on user input keypad 42. Microcontroller 16 then periodically updates the real-time clock at step 68. At step 70, microcontroller 16 comparatively determines if the time value has reached the alarm time value. If so, microcontroller 16 at step 78 enables an alarm warning to wake the user. Microcontroller 16 can activate either a tone alarm or a radio alarm by enabling speech synthesizer 20 through enable/disable line 48 to produce a tone or by enabling radio 22 through enable/disable line 50. Further, either speech synthesizer 20 or radio 22 will then appropriately transmit their signal through speaker 25 to wake the user. As will be apparent to persons skilled in the art, other standard functions of an alarm clock radio device can be implemented by microcontroller 16 in operation with speech synthesizer 20, radio 22, speaker 25, digital display 27, and user keypad 42.

Alerting apparatus 10 also functions as a sophisticated carbon monoxide gas detector and alerting device with specially enhanced auditory and visual warning means 26. At step 80, microcontroller 16 reads the information signal from gas sensor 14 and stores the value of the gas concentration into the variable CONCENTRATION in RAM 19. The value of the variable CONCENTRATION is constantly updates so that its value accords with the most recently measured concentration of carbon monoxide gas. At step 82, microcontroller 16 determines whether any carbon monoxide gas has been detected by determining whether variable CONCENTRATION is non-zero. When microcontroller 16 determines that CONCENTRATION is non-zero, it calls the GAS ALARM CALCULATION routine at step 84, to determine whether alarm conditions are present.

Figure 4:
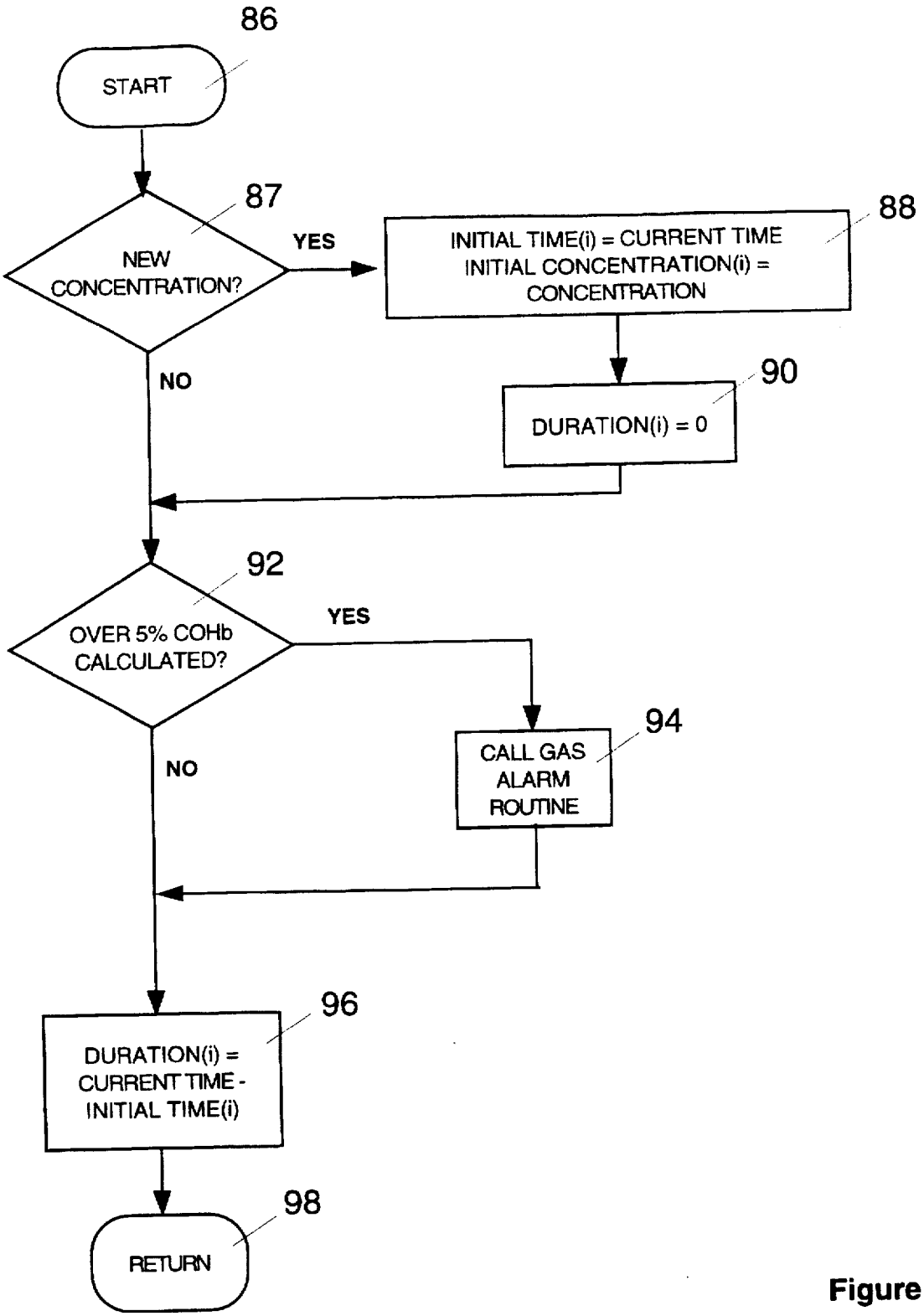
FIG. 4 is a flow-chart of the GAS CALCULATION ALARM routine used for determining the existence of alarm gas conditions for the present invention.

Referring now to FIG. 4, the GAS ALARM CALCULATION routine commences at step 86. At step 87, microcontroller determines whether the variable CONCENTRATION corresponds to an existing element of the variable dimensioned array CONCENTRATION(i) stored in RAM 19. Variable dimensioned array CONCENTRATION(i) stores the various gas concentrations detected by sensor gas 14 during a sensing episode. All elements of the variable dimensioned array CONCENTRATION(i) will be equal to zero when the routine is first traversed.

If the variable CONCENTRATION does not correspond to any existing element of the variable dimensioned array CONCENTRATION(i), then microcontroller 16 at step 88, stores the value of the current time, which represents the time of initial detection of that concentration of gas as a sequential element of variable dimensioned array INITIAL TIME(i) in RAM 19, and stores the value of the variable CONCENTRATION as a sequential element of the variable dimensioned array INITIAL CONCENTRATION (i) in RAM 19. Microcontroller 16 then initiates a timing sequence for each sensed concentration element by storing the value zero in the variable dimensioned array DURATION(i) in RAM 19 at step 90.

Figure 5:
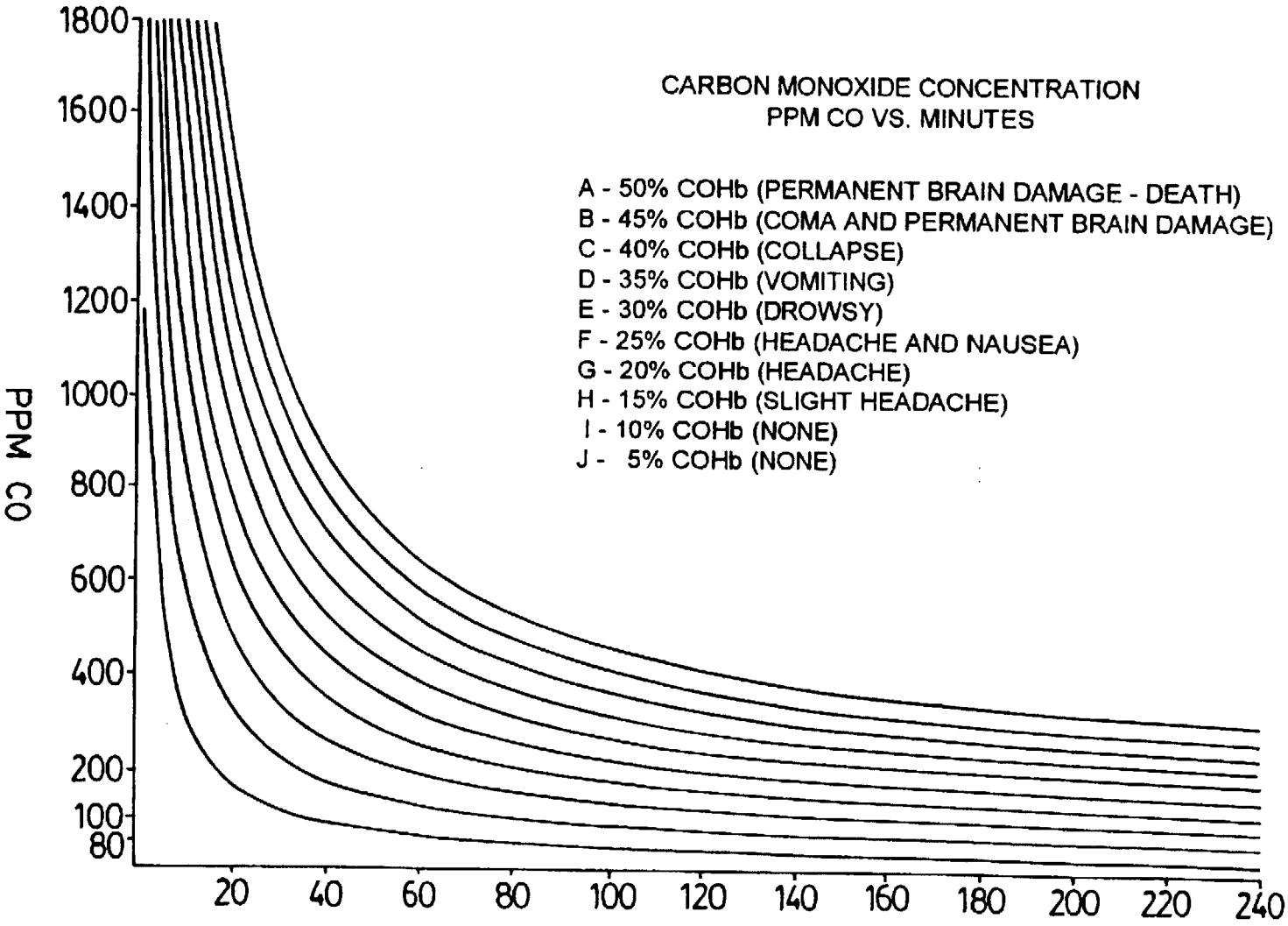
FIG. 5 is a graph illustrating how the concentration of toxic cumulative carboxyhemoglobin in a human body's blood varies with exposure to carbon monoxide at various concentrations and durations according to the Underwriters Laboratories Standard UL 2034.

Referring now to FIGS. 4 and 5, at step 92, microcontroller 16 performs a set of calculations which implement the Underwriters Laboratories Standard UL 2034 relating to the concentration of toxic cumulative carboxyhemoglobin (COHb) resulting from the exposure of a human body to particular levels of carbon monoxide for certain amounts of time. FIG. 5 shows a graph illustrating the relationship between the concentration of carbon monoxide, time of exposure and the approximate percentage of COHb in a human body's blood. The approximate percentage of COHb in a human body's blood can be calculated using the equation:

$$\%\ COHb_t = \%\ COHb_0[e^{-(t/2398\ B)}] + 218[1-e^{-(t/2398\ B)}][0.0003+(ppm\ CO/1316)]$$

where $\%\ COHb_t$ is the percentage of COHb at time t, $\%\ COHb_0$ is the percentage of COHb at time 0, t is the time of exposure in minutes, B is 0.0404 (work effort), and ppm CO is the concentration of carbon monoxide.

The graph provides characteristic curves for various percentages of COHb in blood, indicated as A to J. Alerting apparatus 10 is designed to produce an alarm when the percentage of COHb in blood is equal to or greater than 5% as represented by curve J. Accordingly, microprocessor 16 performs i calculations and in turn equates t with each element of the variable dimensioned array DURATION(i), equates the variable ppm CO with each element of variable dimensioned array CONCENTRATION(i), equates $\%\ COHb_0$ with zero, and calculates variable $\%\ COHb_t$ for each concentration of detected gas. If $\%\ COHb_t$ is calculated to be equal to or greater than 5% for any detected concentration, then microcontroller 16 calls the GAS ALARM routine at step 94.

Microprocessor 16 may alternatively implement the three carbon monoxide concentration and time exposure test specified by the Underwriters Laboratories Standard UL 2034 which stipulates that an alarm be provided for a level of 10% COHb in blood, for the concentration and response times listed in the following table:

| Concentration (ppm) | Time of Exposure (mins) |
|---|---|
| 100 | 90 |
| 200 | 35 |
| 400 | 15 |

Accordingly, microprocessor 16 will compare each element pair of the variable dimensioned arrays CONCENTRATION(i) and DURATION(i) to a hash table containing the pairs listed in the above table. In particular, microprocessor 16 will determine whether the element pairs of variable dimensioned arrays DURATION(i) and CONCENTRATION(i) are equal to or greater than the pair values 100 ppm and 90 minutes, or are equal to or greater than the pair values 200 ppm and 35 minutes, or are equal to or greater than the pair values 400 ppm and 15 minutes. If microprocessor 16 determines that any of these three conditions have been met, then microcontroller 16 calls the GAS ALARM routine at step 94.

Whether or not the GAS ALARM routine is called, at step 96 microcontroller 16 calculates and stores the arithmetic difference between the current time and each element of the variable dimensioned array INITIAL TIME(i) in the appropriate elements of the variable dimensioned array DURATION(i), so that each element of the variable dimensioned array DURATION(i) represents the time which has elapsed since the corresponding concentration of gas was first detected. At step 98, microprocessor 16 then returns to the MAIN OPERATION routine at step 64.

Figure 6:
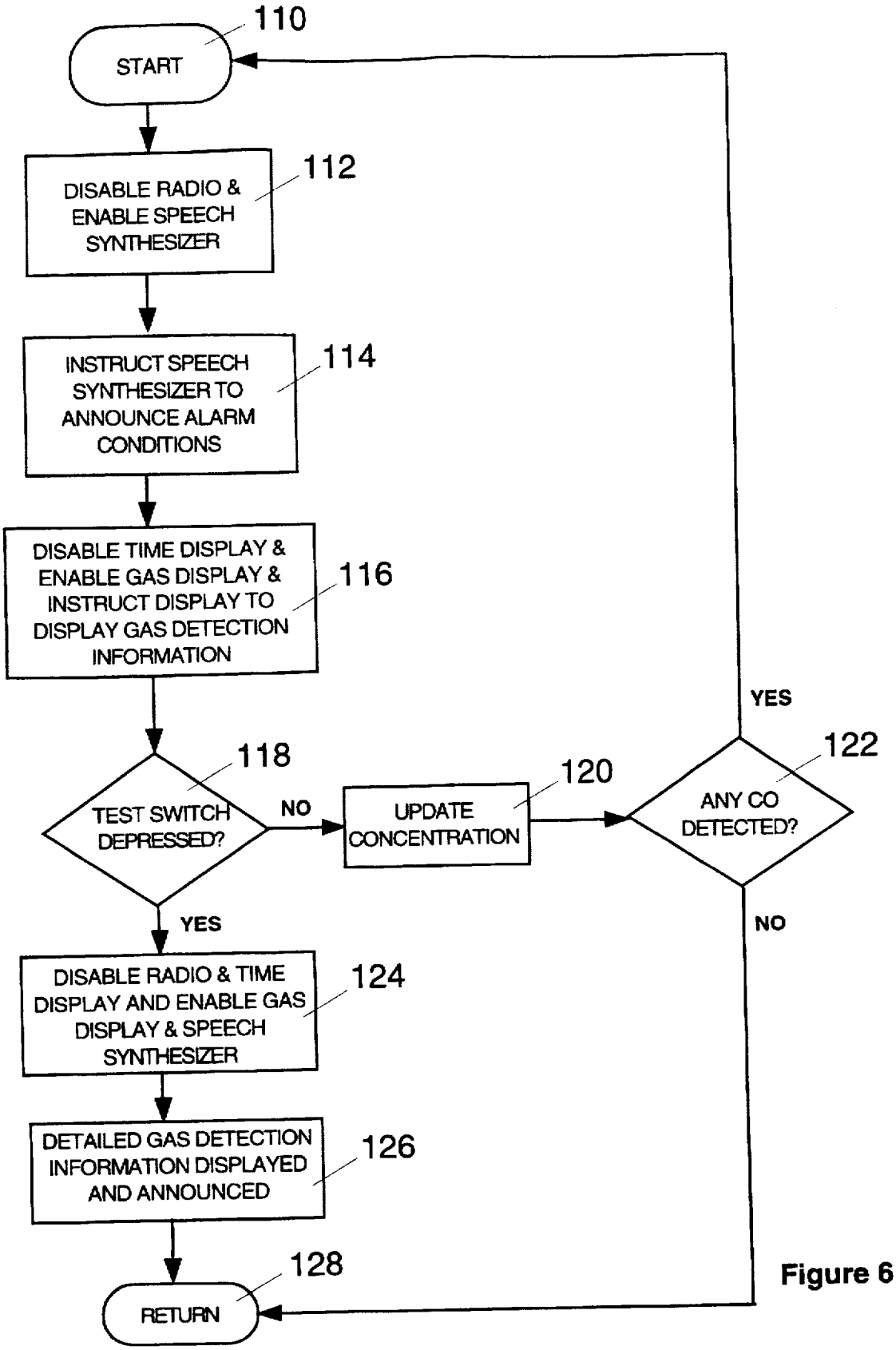
FIG. 6 is a flow-chart of the GAS ALARM routine used to provide gas detection emergency alarm functionality for the present invention.

Referring now to FIGS. 2 and 6, the GAS ALARM routine provides gas detection emergency alarm functionality for alerting apparatus 10. Once the GAS ALARM routine is started at step 110, microcontroller 16 instructs the requisite components to first produce initial emergency visual and auditory alarms. At step 112, microcontroller 16 disables radio 22 through enable/disable line 50 and enables speech synthesizer 20 through enable/disable line 48. At step 114, microcontroller 16 instructs speech synthesizer 20 through information line 46, to select a particular pre-stored audible speech warning message, based on the values of the elements of the variable dimensioned arrays CONCENTRATION(i) and DURATION(i) that satisfied the gas alarm conditions described above.

As an illustration of step 114, microcontroller 16 may instruct speech synthesizer 20 to produce a repeating pre-stored audible speech warning message such as "PLEASE WAKE UP, HIGH LEVELS OF CARBON MONOXIDE DETECTED—VACATE PREMISES IMMEDIATELY" or "PLEASE WAKE UP, LOW LEVELS OF CARBON MONOXIDE DETECTED—PRESS TEST BUTTON FOR MORE INFORMATION". Speech synthesizer 20 may alternatively generate an initial emergency alarm consisting of an alerting tone, audibly distinct from the clock alarm sound. Alternatively, alerting apparatus 10 may utilize buzzer 24, instead of speech synthesizer 20, as the initial emergency warning means. As discussed before, buzzer 24 must conform with the Underwriters Laboratories Standard UL 2034 requiring alarm buzzers to operate with a loudness of at least 85 db at a distance of 10 feet.

To complete the initial emergency alarm, microcontroller 16 at step 116, disables the display of the current time value through enable/disable line 38 and enables gas concentration driver 28 through enable/disable line 34. Microcontroller 16 also sends an information signal along information line 32 to gas concentration driver 28 to instruct digital display 27 to display initial gas detection information in a flashing manner. As an example, the digital display may be instructed to display the basic message: "CO LEVEL AT 100 PPM".

The user may respond to the initial emergency alarm at step 118, by operating a test switch 54 to obtain further historical details relating to the specific concentration and duration of the carbon monoxide gas detected. Test switch 54 is a button switch, spring-biased to its non-depressed position, and signals microcontroller 16 when it is depressed. When the user depresses test switch 54, alerting apparatus 10 provides the user with a combination of detailed audible and visual information using speech synthesizer 20 and digital display 27. It should be noted that the user may retrieve historical gas detection information as updated and stored in RAM 19, by pressing test switch 54 either in the MAIN OPERATION routine at step 130 or in the GAS ALARM routine at step 118.

As long as test switch 54 is not depressed, microcontroller 16 obtains the current concentration value from information signal at step 120, and stores this new value into the variable CONCENTRATION. Microcontroller 16 then determines whether any carbon monoxide gas has been detected at step 122. If carbon monoxide gas is no longer detected, then microcontroller 16 returns to the GAS ALARM CALCULATION routine at step 128. If carbon monoxide gas is still detected, then microcontroller 16 repeats steps 110, 112, 114, 116, 118, 120 and 122 until test switch 54 is depressed.

When test switch 54 is depressed, at step 124, microcontroller 16 disables radio 22 through enable/disable line 50 and enables speech synthesizer 20 through enable/disable line 48. Microcontroller 16 also disables the display of the current time value through enable/disable line 38 and enables gas concentration driver 28 through enable/disable line 34.

At step 126, microcontroller 16 sends an information signal along information line 46 instructing speech synthesizer 20 to generate an audible speech message containing provided numerical data in the following manner. Speech synthesizer 20 is instructed to generate a speech warning message produced by incorporating and vocalizing the appropriate elements of the variable dimensioned arrays CONCENTRATION(i), INITIAL TIME(i) and DURATION (i) stored in RAM 19. For example, the values, CONCENTRATION(3)=400, INITIAL TIME(3)=15:00, and DURATION(3)=30, could be incorporated into the appropriate ROM-stored preset speech message template "_____ PPM'S OF CARBON MONOXIDE WAS FIRST DETECTED AT _____ FOR _____ MINUTES" to produce the message: "FOUR HUNDRED PARTS PER MILLION OF CARBON MONOXIDE WAS FIRST DETECTED AT THREE AM FOR THIRTY MINUTES". To form the detailed visual display, microcontroller 16 sends an information signal along information line 32 to gas concentration driver 28 to drive digital display 27 to display the particular historical detection information. As an example, the digital display may be instructed to display the more detailed message: "100 PPM AT 15:00 FOR 30 MINS".

Now referring to FIGS. 2, 4, and 6, once test switch 54 has been depressed and steps 124 and 126 have been traversed, microcontroller 16 will re-enter the GAS ALARM CALCULATION routine at step 96. As described above at step 96 microcontroller 16 determines and stores the appropriate elements of DURATION(i) and microcontroller 16 will then re-enter the MAIN OPERATION routine at step 64. Once the MAIN OPERATION routine is re-entered at step 64, as discussed before, the user may retrieve stored historical gas detection event information as stored in RAM 19, by depressing test button 54 at step 130.

In use, alerting apparatus 10 functions in the absence of a minimum level of detected carbon monoxide gas as a commercially available alarm clock radio. A user may program current time and alarm time values and otherwise operate alerting apparatus 10 as he would normally operate an alarm clock radio. Alerting apparatus 10 provides the user with a current time value as well as with a wake-up alarm. The user may set the wake-up alarm time and may select whether alerting apparatus 10 will sound a tone alarm or enable the radio to effect the wakeup alarm.

When the alerting apparatus 10 first detects the presence of carbon monoxide gas, it starts to perform periodic calculations to determine whether alerting conditions are met.

These calculations are performed until either alarm conditions are met or the detected concentration of the gas drops below the preset minimum concentration. Once alerting apparatus 10 determines that alerting conditions are met, the user is alerted by an initial warning comprising a flashing digital display of gas concentration information and an audible speech message announcing the level of danger.

By depressing test switch 54, the user can retrieve further concentration and duration information concerning the detected carbon monoxide gas. After test switch 54 is depressed, while alerting apparatus 10 appears to return to normal operation, microcontroller 16 continues to update the alarm event history as long as carbon monoxide is still present. The user may at any time press test switch 54 to retrieve historical gas detection information as updated and stored in the RAM of microcontroller 16.

In summary, the present invention provides a user with alerting apparatus 10, adapted to be operated in a residential bedroom, and which provides an initial a visual display and audible speech warning of carbon monoxide gas detection information. The audible speech warning consists of safety instructions appropriate to the concentration of carbon monoxide gas detected and time of exposure. The user can then retrieve detailed historical gas detection event information by depressing test button 54. In this fashion, the user is provided with sufficient information to make an informed decision as to the proper emergency response. apparatus 10 also allows safety officials the facility to retrieve historical information relating to the specific concentration detected and duration of detection, for diagnostic use.

While the preferred embodiment of alerting apparatus 10 includes a clock radio, it could be used with an alarm clock which does not include a radio. Alerting apparatus 10 could be adapted for use with components such as a compact disc player or a tape deck in place of radio 22. Further, gas sensor 14 can alternatively comprise a sensor for detecting the presence of other hazardous gases in the residential atmosphere, such as smoke, natural gas, gasoline vapours, hydrogen or methane.

As will be apparent to persons skilled in the art, various modifications and adaptations of the structure described above are possible without departure from the present invention, the scope of which is defined in the appended claims.

We claim:

1. Apparatus for alerting residents to hazardous gas concentrations, comprising:

(a) an alarm clock for tracking the current time of day and issuing a wake-up alarm and comprising a clock display;

(b) a gas sensor for sensing various concentrations of a specified hazardous gas and generating sensor signals correlatable therewith;

(c) a controller operatively coupled to the alarm clock and the gas sensor, for determining durations of the various concentrations based upon the sensor signals and for generating output signals indicative of the various concentrations and the durations; and (d) wherein the clock display displays either the time of day or a visual warning message indicative of a particular concentration and duration of a specified hazardous gas, based upon the output signals; and (e) speech synthesizer means for issuing one of a plurality of distinct audible speech messages, based upon the output signals, wherein each speech message is indicative of a particular concentration and duration of a specified hazardous gas.

2. The apparatus defined in claim 1, wherein the controller comprises:

(i) timing means for generating a real time signal for the alarm clock and a real time display signal for the clock display, and for generating an enabling signal to activate the wake-up alarm signal when wake-up alarm conditions have been met;

(ii) input means coupled to the gas sensor for receiving the sensor;

(iii) processing means for processing the sensor signals and generating an enabling signal to activate a hazardous gas warning when a set of hazardous gas warning alarm conditions have been met; and (iv) output means for generating a speech warning signal for the speech synthesizer means, and for generating a display warning signal for the clock display.

3. The apparatus claimed in claim 2, wherein the processing means comprises:

(a) means for determining the gas concentration from the input signals;

(b) means for utilizing the timing means to calculate the duration of the gas concentration;

(c) means for determining whether the gas concentration and the duration of the gas concentration satisfies the set of hazardous gas warning alarm conditions;

(d) means for generating the enabling signal to activate the hazardous gas warning, comprising initial visual and speech warnings, when the gas concentration and the duration of the gas concentration satisfy the set of hazardous gas warning alarm conditions; and (e) means for receiving a test switch signal from the user and generating an enabling signal to activate the hazardous gas warning, comprising detailed visual and speech warnings.

4. The apparatus claimed in claim 1, wherein the alarm clock includes a radio and wake-up alarm means for providing an alternative wake-up alarm for the alarm clock utilizing the radio.

5. The apparatus claimed in claim 2, wherein the processing means includes means for inputting and storing an alarm time value, comparing the real time signal and the alarm time value, and generating the wake-up alarm signal when the real time signal and the alarm time value are equal.

6. The apparatus claimed in claim 4, wherein the wake-up alarm means includes a buzzer, and the controller generates a signal to activate the buzzer.

7. The apparatus claimed in claim 6, wherein the buzzer produces sound having loudness of at least 85 decibels at 10 feet.

8. The apparatus claimed in claim 3, wherein the gas sensor is a carbon monoxide sensor.

9. The apparatus claimed in claim 8, wherein the set of hazardous gas warning alarm conditions determine whether a level of carboxyhemoglobin in blood is equal to or greater than a pre-selected percentage, based on the gas concentration and duration of gas detection.

10. The apparatus claimed in claim 9, wherein the speech synthesizer means issues a plurality of distinct speech messages, and wherein each of the speech messages is indicative of a different percentage of carboxyhemoglobin in blood.

11. The apparatus claimed in claim 9, wherein the pre-selected percentage is 5%.

12. The apparatus claimed in claim 9, wherein the hazardous gas warning alarm conditions consist of a set of pre-set industry standard values.

13. The apparatus claimed in claim 12, wherein the pre-set industry standard values are 100 parts per million for 90 minutes, 200 parts per million for 35 minutes, and 400 parts per million for 15 minutes.

14. A method for alerting residents to hazardous gas concentrations, said method comprising the steps of:

(a) generating real time values;

(b) sensing the concentration of a specified hazardous gas;

(c) upon sensing a non-zero concentration of the specified hazardous gas, determining the duration of the concentration of the gas, by storing and comparing appropriate real time values;

(d) determining whether the concentration of the gas and the duration of the concentration of the gas satisfy a set of hazardous gas warning alarm conditions;

(e) upon determining that the set of hazardous gas warning alarm conditions is satisfied, producing an initial visual warning indicative of a particular concentration and duration of a specified hazardous gas and selecting and producing an initial audible speech warning comprising safety instructions relating to a particular concentration and duration of a specified hazardous gas; and (f) upon receiving a test switch signal from the user, producing a detailed visual warning relating to historical information of particular concentrations and durations of a specified hazardous gas and selecting and producing a detailed audible speech warning relating to historical information of particular concentrations and durations of a specified hazardous gas.

15. The method as defined in claim 14, wherein the hazardous gas is carbon monoxide, and the set of hazardous gas warning alarm conditions is based upon whether the concentration of the gas and the duration of the concentration of the gas correspond to a level of carboxyhemoglobin in blood equal to or greater than a pre-selected percentage.

16. The method claimed in claim 15, wherein the pre-selected percentage is 5%.

* * * * *